US005664766A

United States Patent [19]

Baziuk

[11] Patent Number: 5,664,766

[45] Date of Patent: Sep. 9, 1997

[54] WINCH WITH REVERSE ROTATION PROTECTION

[75] Inventor: Morris Baziuk, Winnipeg, Canada

[73] Assignee: Unique Concepts Ltd., Winnipeg, Canada

[21] Appl. No.: 649,516

[22] Filed: May 17, 1996

[51] Int. Cl.[6] ..... B66D 5/32

[52] U.S. Cl. ..... 254/375; 242/579; 254/DIG. 14

[58] Field of Search ..... 254/323, 375, 254/376, DIG. 14; 242/579, 586.5

[56] References Cited

U.S. PATENT DOCUMENTS

| | | | |
|---|---|---|---|
| 1,555,544 | 9/1925 | Anthony | 254/DIG. 14 |
| 2,019,512 | 11/1935 | Stahl | 254/375 |
| 2,053,976 | 9/1936 | Stahl | 254/375 |
| 5,125,628 | 6/1992 | Rempinski et al. | 254/323 |
| 5,290,014 | 3/1994 | Fergison, Jr. | 254/323 |
| 5,344,121 | 9/1994 | Baziuk . | |
| 5,415,377 | 5/1995 | Britt et al. | 254/323 |

*Primary Examiner*—Katherine Matecki

*Attorney, Agent, or Firm*—Adrian D. Battison; Murray E. Thrift

[57] ABSTRACT

A winch drum having a cable wrapped around a cylindrical surface of the drum and clamped to one end plate of the drum is modified by the addition of a member which inhibits reverse winding of the cable onto the drum. The member is attached to the clamped end of the cable and includes a tubular portion which is arcuate so as to follow the curvature of the cylindrical surface of the drum with a part cylindrical plate portion which projects outwardly to one side of the cable so as to lie flat against the cylindrical surface of the drum. When the cable is paid out to the maximum position, the member leaves the drum and impacts the frame of the winch to prevent or inhibit continued rotation of the drum in the payout direction which would otherwise cause winding of the cable in the reverse direction. The device for preventing reverse winding is particularly useful in winches which include a safety brake to restrict and control payout of the cable.

9 Claims, 2 Drawing Sheets

WINCH WITH REVERSE ROTATION PROTECTION

BACKGROUND OF THE INVENTION

This invention relates to a winch which includes a member attached to the cable adjacent its fixed end to the winch drum to prevent or inhibit continued rotation of the drum in a direction to pay out the cable which would otherwise cause reverse winding of the cable onto the drum.

Winches of course generally include a drum mounted in a frame and rotatable relative to the frame. The drum includes a cylindrical surface around which a cable is wound. With the cable wound in a first direction from a first fixed end of the cable, rotation of the drum in the same first direction acts to pay out the cable and rotation of the drum in the second opposed direction acts to wind in the cable.

If the winch drum is rotated in the first direction paying out the cable to a position angularly beyond the position in which all of the cable is paid out, the cable is kinked back on itself and then is wound in the second direction around the drum.

In many winches the direction of winding of the cable onto the drum is of little importance except that of course it reverses the direction of rotation necessary to wind in and payout the cable.

However some winches, particularly those used for safety situations include a brake which will prevent the winch drum from rotating in the payout direction in the event that there is a significant pulling force on the cable due to for example the falling of a person being winched or pulled in.

One example of a winch of this type is shown in U.S. Pat. No. 5,344,121 of the present inventor.

In the event that a winch of this type is taken beyond the maximum payout position of the cable and the cable rewound in the opposed direction, the brake becomes inoperative and the safety provided by the winch is compromised.

Up till now this problem has been inhibited simply by providing markings on the cable to warn the user that the end position is approaching. However situations have been encountered where the warning markings have been ignored and the winch drum rotated beyond the maximum payout position so that the cable is wound in the opposed or wrong direction.

SUMMARY OF THE INVENTION

It is one object of the present invention, therefore, to provide an improved winch which has enhanced safety features.

According to one aspect of the invention there is provided a winch comprising: a winch cable; a winch drum having a cylindrical surface for receiving turns of the winch cable wrapped therearound; means mounting the winch drum for rotation about an axis longitudinal of the cylindrical surface; the winch cable having a first end attached to the drum for rotation therewith and a second free end for attachment to an object to be wound in and being wrapped around the drum in a first direction such that rotation of the drum in the first direction pays out the winch cable and such that rotation of the drum in the second opposed direction winds in the cable; and a member attached to the cable adjacent the first attached end for inhibiting winding of the cable onto the drum in the second direction in the event that the drum is rotated in the first direction angularly beyond a position in which all of the cable is paid out.

One embodiment of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Figure 1:
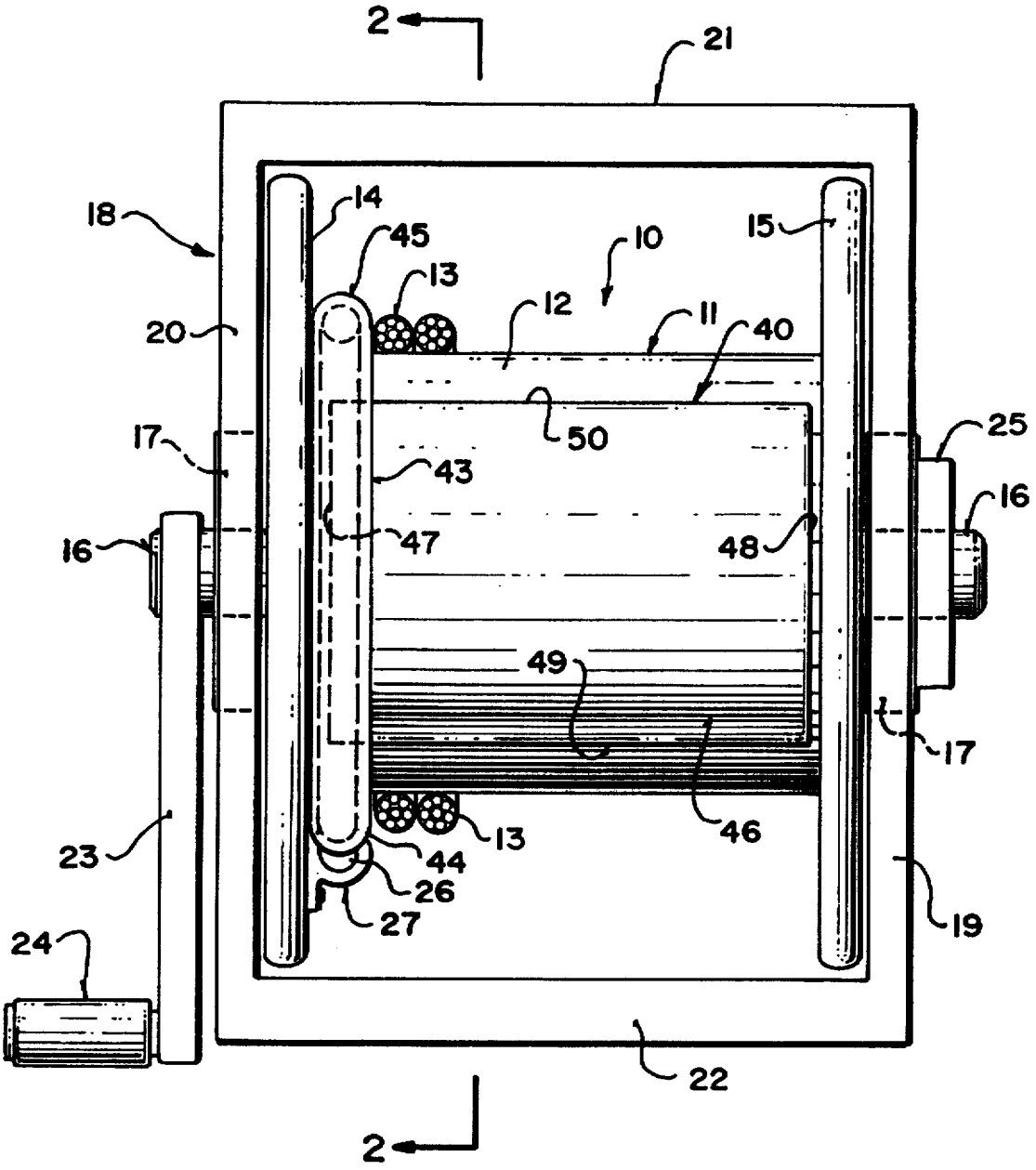
FIG. 1 is a top plan view of a winch according to the present invention.
Figure 2:
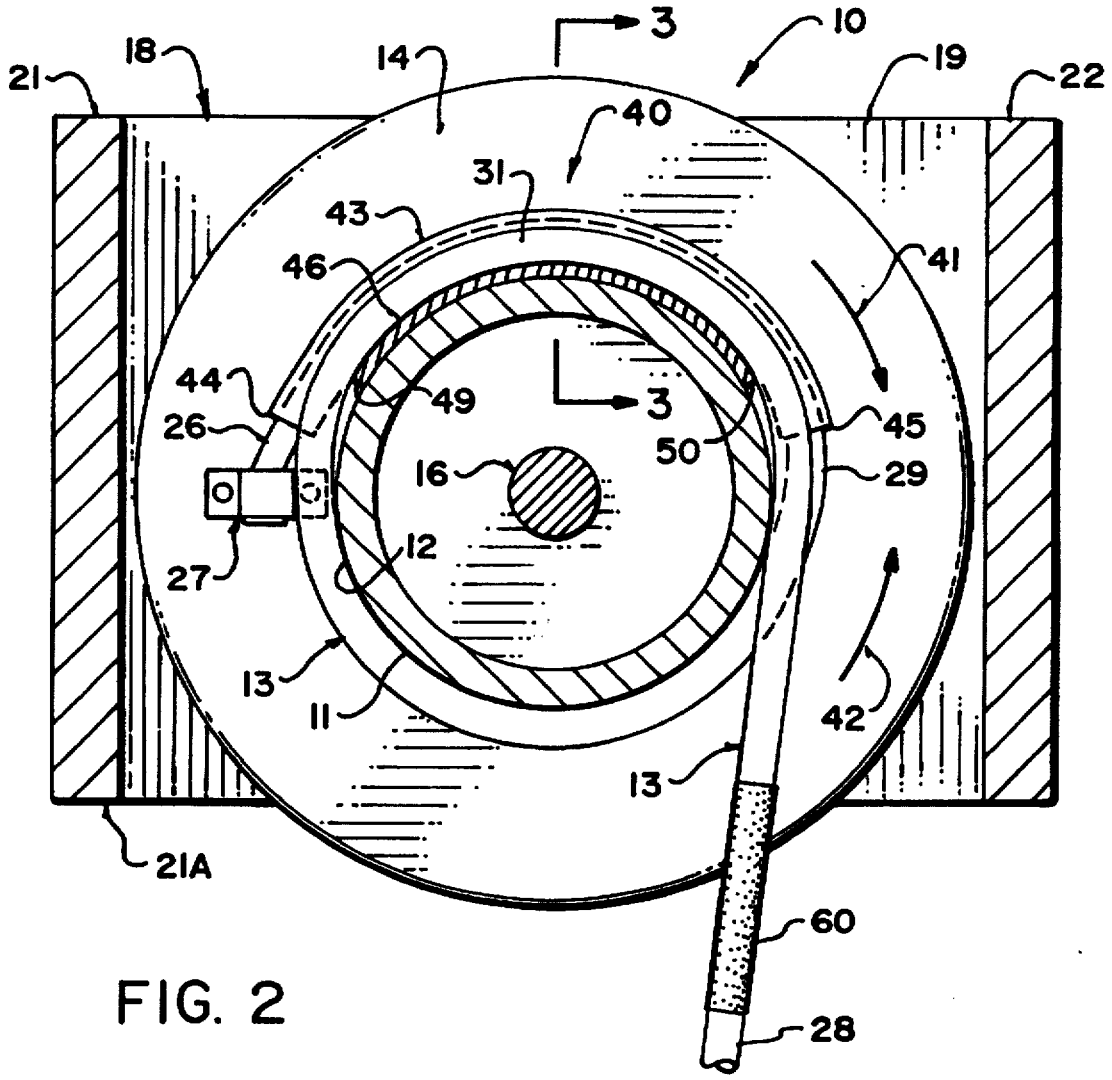
FIG. 2 is a cross sectional view along the lines 2—2 of FIG. 1.
Figure 3:
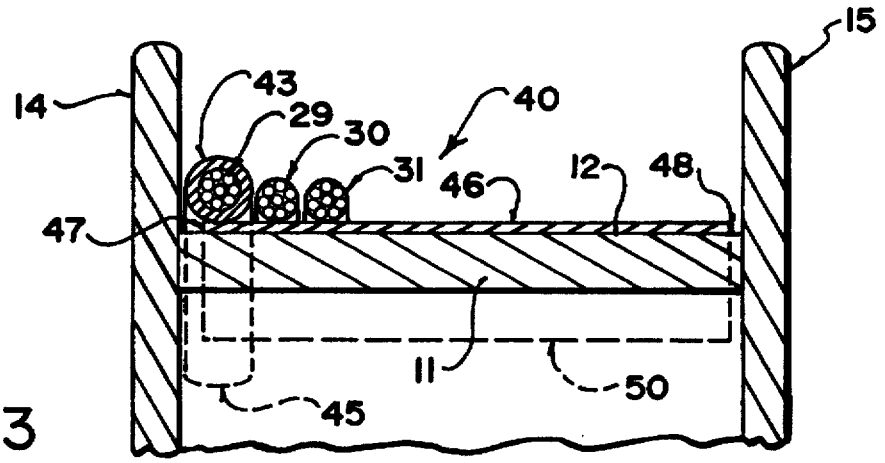
FIG. 3 is a cross-sectional view along the lines 3—3- of FIG. 2.

The winch shown in FIGS. 1, 2 and 3 comprises a winch drum 10 including a cylindrical drum portion 11 having a cylindrical outer surface 12 for receiving a winch cable 13 wrapped therearound in parallel side by side turns and in rows of those turns. The drum further includes circular end plates 14 and 15 which are attached to ends of the cylindrical drum portion 11 to define a receptacle for the wrapped turns of cable. The drum is mounted on a shaft 16 carried in bearings of a frame generally indicated at 18. The frame includes two side plates 19 and 20 together with end plates 21 and 22 interconnecting the side plates 19 and 20. Thus the frame forms a rectangular structure usually having an open top and an open bottom at which the drum 10 is exposed. The shaft 16 is attached to a handle 23 which can be manually actuated by hand grasp portion 24 for rotating the shaft 16 and therefore the drum in either direction for paying out and winding in the cable 13. A brake 25 is provided between the shaft and the frame so as to restrict rotation of the drum in the payout direction except when the handle is rotated to payout the cable in a controlled manner. Thus the brake will prevent uncontrolled pulling of the cable in the event that a significant force is applied to the cable.

The cable includes an attached first end 26 which is connected to the drum 10 by a suitable clamp. In the example shown the clamp comprises a screw fastened collar 27 which engages the end 26 and clamps it to the end plate 14. The cable further includes a free end 28 for attachment to an object to be moved by the winch. In the figures, the cable is shown in a condition in which the majority of the cable is paid out so that only a few turns of the cable remain on the drum including an end turn 29 of the cable at the end plate 14 and two adjacent turns 30, 31 laid down in helical manner adjacent the end turn 29.

The above described structure of winch is entirely conventional and it will be appreciated that the illustration is relatively schematic showing only one simple example of a winch driven by a simple handle. It will of course be appreciated that the structure of the winch can be modified in many different ways or within the knowledge of one skilled in the art.

In the present invention the conventional winch is modified by the addition of a member 40 which is attached to the cable adjacent the attached end 26 to prevent or inhibit reverse winding of the cable onto the drum.

Thus it will be appreciated that, as best shown in FIG. 2, from the attached end 26 the cable is wrapped around the drum in a first direction 41 so that the cable is wrapped in a clockwise direction toward the free end 28. It will be further appreciated that rotation of the drum by the handle 23 in the first direction 41 will cause payout of the cable from the drum. Also it will be appreciated that rotation of the drum in a second opposed direction 42 will cause wind up of the cable onto the drum.

In the event that the drum is rotated in the direction 41 to effect payout of the cable to a position in which the attached end 26 passes the position that the cable leaves the drum, the cable will commence rotation in the opposite direction, in the absence of the additional member 40 which prevents or inhibits such rotation.

The member 40 comprises a first portion 43 in the form of a rigid arcuate portion having a length of arc less than 180°. In particular the portion 43 comprises a tube through which the cable passes with that tube to form an arc and with that tube having an inside surface following the curvature of the surface 12. The tube has a first end 44 closely adjacent or at the attachment end 26 of the cable and a second end 45 spaced angularly around the drum surface 12. The cable is clamped inside the tube or spot welded to the tube to prevent the tube from sliding off the cable or moving along the cable. As the portion 43 comprises a tube, the ends of the cable are fixed relative to the portion 43.

The member 40 further includes a plate portion 46 which is attached to the first portion 43 and extends outwardly therefrom to one side thereof. The plate portion 46 is part cylindrical in shape so that it is arcuate in transverse cross section as best shown in FIG. 2. The curvature of the plate follows the curvature of the surface 12 so that it lies flat against the surface 12. The length of the plate so that is arranged so that it extends from a first end 47 attached to the tube portion 43 to a second end 48 closely adjacent the end plate 15 of the drum. The plate portion also has side edges 49 and 50 angularly spaced around the drum. The width of the plate between the side edges 49 and 50 is slightly less than the length of the tube 43 between the ends 44 and 45.

In normal operation, when the cable is initially wound around the drum, the member 40 lies down onto the surface 12 with the tube portion 43 lying adjacent or butting the end plate 14 in view of the fact that it is adjacent the clamped end 26 of the cable which is attached to the end plate 14.

Further rotation of the drum in the direction 42 to wind in the cable causes the cable to wind in turns wrapped around the drum and thus overlying the outer surface of the plate portion 46. If properly guided the cable lies in turns which are side by side as shown but of course this is not necessary for proper winding of the cable and the cable may wrap freely around the drum at various axial positions along the length of the drum to build up wraps of turns around the drum. In any event all of the turns lie on top of the outer surface of the plate portion 46.

When the drum is turned in the direction 41 to payout the cable, the cable is freely paid out to a position approaching the clamped end 26 at which is provided a marker 60 on the cable for indicating to the operator that the cable is approaching the end and should not be further paid out.

In the event that the marker 60 is ignored and continued rotation of the drum in the direction 41 occurs, the cable continues to be paid out until the end 45 of the tube 43 reaches a position adjacent the bottom of the drum, at which time it is pulled away from the drum so that the portion 43 carrying the plate 46 is pulled away from the drum and carried on that portion of the cable which depends from the bottom of the drum below the clamp 27. This action tends to twist the cable so that the plate portion projects outwardly away from the cable in the form of a flap. In the event that the drum is yet further rotated in the direction 41, the clamp 27 commences rotation around with the drum from a position adjacent the bottom of the drum upwardly toward the left in the view of FIG. 2 and the flap provided by the plate portion 46 impacts a bottom edge 21A of the end plate 21 and thus inhibits or prevents further rotation of the drum in that direction. At this position it is entirely clear to the operator that there is an inhibition of the movement and the operator cannot continue to rotate the drum in that direction without causing damage to the structure.

Thus when the operator has realized that the rotation in the direction 41 is inhibited, the operator will reverse the direction to rewind the cable onto the drum. This movement in the direction 42 causes the tube portion 43 to be laid back down in its initial position adjacent the end plate 14. Similarly the plate portion 43 is laid back down onto the surface 12 allowing further turns of cable to be wrapped.

While the member as described and shown in the embodiment includes the tubular portion 43 and the plate portion 46, both of which are arcuate, it will be appreciated that alternative shapes can be used which act to inhibit the movement of the cable in the reverse direction.

Since various modifications can be made in my invention as herein above described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A winch comprising:

a winch cable;

a winch drum having a cylindrical surface for receiving turns of the winch cable wrapped therearound;

means mounting the winch drum for rotation about an axis longitudinal of the cylindrical surface;

the winch cable having a first end attached to the drum for rotation therewith and a second free end for attachment to an object to be wound in and being wrapped around the drum in a first direction such that rotation of the drum in the first direction pays out the winch cable and such that rotation of the drum in the second opposed direction winds in the cable;

and a member attached to the cable adjacent the first end for inhibiting winding of the cable onto the drum in the second direction in the event that the drum is rotated in the first direction angularly beyond a position in which all of the cable is paid out;

the member comprising:

a rigid arcuate portion having a curvature substantially following that of the periphery of the drum and extending over an arc of less than 180° so as to lie around a portion of the drum which portion is held onto the cable so that each end of the portion is attached to the cable;

and a plate portion having one edge attached to the rigid arcuate portion so as to extend outwardly to one side of the cable.

2. The winch according to claim 1 wherein the rigid arcuate portion is a tube with the cable passing therethrough.

3. The winch according to claim 1 wherein rigid arcuate portion is attached to an end turn of the cable and the plate portion underlies a plurality of turns of the cable lying side by side with the end turn of the cable.

4. The winch according to claim 1 wherein the plate portion extends substantially across a full width of the drum surface.

5. The winch according to claim 1 wherein the member is attached to the cable at a position thereon spaced from the end attached to the drum such that the end of the cable is attached to the drum independently of the member and the member is free from direct connection to the drum.

6. A winch comprising:

a winch cable;

a winch drum having a cylindrical surface for receiving turns of the winch cable wrapped therearound;

means mounting the winch drum for rotation about an axis longitudinal of the cylindrical surface;

the winch cable having a first end attached to the drum for rotation therewith and a second free end for attachment to an object to be wound in and being wrapped around the drum in a first direction such that rotation of the drum in the first direction pays out the winch cable and such that rotation of the drum in the second opposed direction winds in the cable;

and a member attached to the cable adjacent the first end for inhibiting winding of the cable onto the drum in the second direction in the event that the drum is rotated in the first direction angularly beyond a position in which all of the cable is paid out;

wherein the member comprises:

a first portion which is attached to the cable at a position thereon different from the end attached to the drum such that the end of the cable is attached to the drum independently of the member, such that the member is free from direct connection to the drum and such that the first portion lies partly on the drum when a turn of the cable containing said position on the cable is wrapped around the drum;

and a second portion extending outwardly from the first portion to one side thereof such that the second portion lies against the drum and underlies turns of cable lying alongside said turn.

7. The winch according to claim 6 wherein the first portion comprises an arcuate tube with the cable passing therethrough.

8. The winch according to claim 6 wherein the second portion comprises a part cylindrical member which extends angularly around a portion of the drum surface.

9. The winch according to claim 6 wherein the second portion extends substantially across a full width of the drum surface.

* * * * *